US005152664A

United States Patent [19]

Huang

[11] Patent Number: 5,152,664

[45] Date of Patent: Oct. 6, 1992

[54] STEAM TURBINE WITH IMPROVED BLADE RING AND CYLINDER INTERFACE

[75] Inventor: Kuo P. Huang, Winter Springs, Fla.

[73] Assignee: Westinghouse Electric Corp., Pittsburgh, Pa.

[21] Appl. No.: 765,769

[22] Filed: Sep. 26, 1991

[51] Int. Cl.[5] ..... F01D 25/26

[52] U.S. Cl. ..... 415/134; 415/108

[58] Field of Search ..... 415/134, 135, 136, 137, 415/138, 139, 108

[56] References Cited

U.S. PATENT DOCUMENTS

| | | | |
|---|---|---|---|
| 3,592,557 | 7/1971 | Haas | 415/108 |
| 3,754,833 | 8/1973 | Remberg | 415/134 |
| 4,362,464 | 12/1982 | Stock | 415/136 |
| 4,840,537 | 6/1989 | Silvestri, Jr. | 415/202 |

FOREIGN PATENT DOCUMENTS

| | | | |
|---|---|---|---|
| 569233 | 1/1959 | Canada | 415/108 |
| 1085539 | 7/1960 | Fed. Rep. of Germany | 415/134 |
| 593918 | 10/1947 | United Kingdom | 415/134 |

*Primary Examiner*—John T. Kwon
*Attorney, Agent, or Firm*—G. H. Telfer

[57] ABSTRACT

A steam turbine having a inner cylinder with a plurality of steam inlets which feed a plurality of nozzle blocks and a curtis stage blade ring with a circumferential groove which cooperates with a circumferential tongue extending from the inner cylinder to position the blade ring properly within the cylinder, the tongue has a plurality of ports each of which have a kerf extending from each port through an inner circumferential margin of the tongue to eliminate heat induced stress cracking between the ports and inner circumferential margin of the tongue.

3 Claims, 2 Drawing Sheets

STEAM TURBINE WITH IMPROVED BLADE RING AND CYLINDER INTERFACE

BACKGROUND OF THE INVENTION

The invention relates to a steam turbine and more particularly to an improved Curtis blade ring and inner cylinder interface.

In steam turbines with a circumferential tongue supporting the Curtis stage blade ring, steam flows through ports in the tongue and when operating in a load following mode the steam temperature varies from 750° F. at partial load to about 950° F. at full load. The temperature of the heavy inner cylinder wall remains substantially lower constraining expansion of the tongue resulting in high magnitude compressive stresses in the tongue and plastic deformation. These strains are reversed when the turbine is taken off the line and cools leading to eventual thermal fatigue and cracking of the tongue.

SUMMARY OF THE INVENTION

Among the objects of the invention may be noted the provision of a tongue which will not be subjected to thermal stresses that induce cracking of the tongue.

In general, a steam turbine has a cylinder with a plurality of steam inlets which feed a plurality of nozzle blocks and a curtis stage blade ring disposed adjacent the nozzle blocks. The blade ring has a circumferential groove, which cooperates with a circumferential tongue extending from the cylinder to position the blade ring properly within the cylinder. The tongue has a plurality of ports which allow steam from the curtis stage to circulate over the inlet nozzles and flow to other stages in the turbine When made in accordance with this invention, the tongue comprises a kerf extending from each port through an inner circumferential margin thereof to reduce heat induced stresses between the ports and inner circumferential margin of the tongue and eliminate cracking therein.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
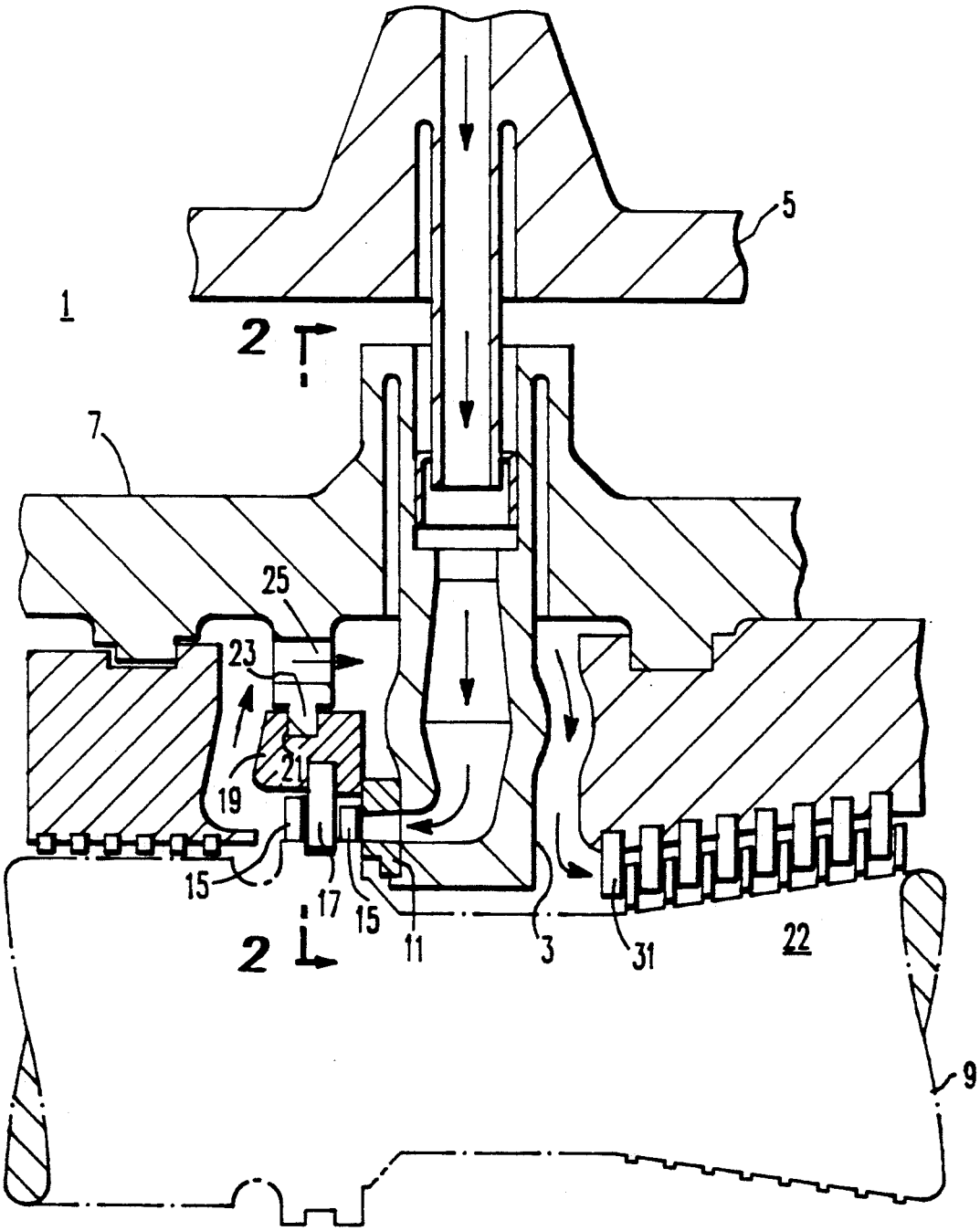
FIG. 1 is a partial sectional view of a curtis stage of a steam turbine.
Figure 2:
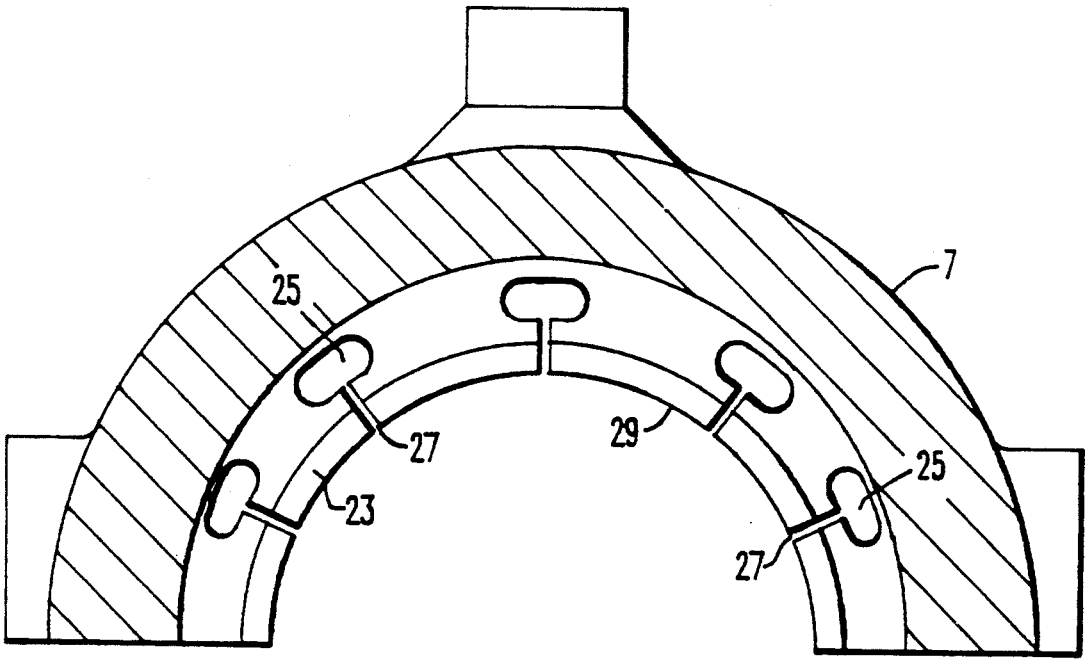
FIG. 2 is a partial sectional view of an inner cylinder showing a tongue which supports a curtis stage blade ring of a steam turbine.

Referring now to the drawings in detail and in particular to FIGS. 1 and 2 there is shown a portion of a steam turbine 1 adjacent a steam inlet nozzle 3. The turbine 1 has an outer housing or casing 5, an inner cylinder 7 disposed within the housing 5 and a rotor 9 rotatably mounted in the cylinder 7 and housing 5. A plurality of inlet nozzles 3 supply steam at a temperature of about 1050° F. to a plurality of nozzle blocks 11. Nozzles 13 within the nozzle blocks 11 direct the steam to a Curtis or control stage made up of two rows of rotating impulse blades 15 with a stationary blade row 17 interposed therebetween. The stationary blade row 17 is disposed in a blade ring 19. The outer periphery of the blade ring 19 has a circumferential groove 21, which receives and cooperates with a circumferential tongue 23 extending radially inwardly from the inner cylinder 7. The circumferential tongue 23 has a plurality of generally elliptical shaped ports 25 disposed therein to allow steam from the curtis stage to flow back over the outside of the inlet nozzle 3 and to other stages 22 of the turbine 1. Upon leaving the Curtis stage the steam is at a temperature of about 950° F. at full load and about 750° F. at partial load. The heavy wall inner cylinder is at much lower temperature subjecting the tongue 23 to high thermal stresses during start up and load shifts when operating in a load following mode as the relatively cool heavy inner cylinder wall restricts thermal expansion of the tongue 23. The thermal stresses have resulted in cracks appearing adjacent the ports 25. To eliminate the cracks and reduce the thermally induced stresses, kerfs 27 are cut in the tongue 23 so as to extend generally radially between the ports 25 and an inner circumferential margin 29 of the tongue adjacent the central portion of the tongue 23. The open area of the ports 25 and kerfs 27 combine to provide the proper area for steam to flow from the Curtis stage, over the inlet nozzle 3 and to a first Rateau stage 31 of the turbine 1.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A steam turbine having a cylinder with a plurality of steam inlets which feed a plurality of nozzle blocks and a curtis stage blade ring disposed adjacent said nozzle blocks, said blade ring having a circumferential groove which cooperates with a circumferential tongue extending from the cylinder to position the blade ring properly within the cylinder, the tongue having a plurality of ports which allow steam from the curtis stage to circulate over the inlet nozzles and to other stages of the turbine, the improvement being a kerf extending from each port through an inner circumferential margin of the tongue to reduce heat induced stresses between the ports and inner circumferential margin of the tongue and prevent cracking thereof.

2. The turbine of claim 1, wherein the kerfs in the tongue extend radially between the ports and the inner circumferential margin of the tongue.

3. The turbine of claim 1, wherein the kerfs are disposed adjacent the central portion of the ports.

* * * * *